United States Patent [19]

Chiu et al.

[11] Patent Number: 4,701,076

[45] Date of Patent: Oct. 20, 1987

[54] TERMINATOR ASSEMBLY FOR A FLOATING STRUCTURE

[75] Inventors: Hin Chiu, Meadows; Johnce E. Hall, Kingwood, both of Tex.

[73] Assignee: Amoco Corporation, Chicago, Ill.

[21] Appl. No.: 893,067

[22] Filed: Aug. 1, 1986

[51] Int. Cl.[4] ..... E02B 17/00; B63B 35/44

[52] U.S. Cl. ..... 405/224; 405/195

[58] Field of Search ..... 405/224, 225, 226, 203, 405/204, 195; 114/264, 265

[56] References Cited

U.S. PATENT DOCUMENTS

| | | | |
|---|---|---|---|
| 4,226,555 | 10/1980 | Bourne et al. | 405/224 |
| 4,374,630 | 2/1983 | Fraser | 405/224 |
| 4,516,882 | 5/1985 | Brewer et al. | 405/224 |

*Primary Examiner*—Dennis L. Taylor

*Attorney, Agent, or Firm*—Scott H. Brown; Fred E. Hook

[57] ABSTRACT

A terminator assembly is disclosed herein for use in mooring a floating structure to the floor of a body of water. A hawsepipe extends downwardly from adjacent an upper support on the floating structure and is supported by a lower support. Tension members utilized from mooring the floating structure extend downwardly from adjacent the upper support through the hawsepipe and a lower end of the tension member is adapted for connection to the floor of the body of water. A locking device is connected to an upper portion of each tension member for maintaining the tension member in tension by acting upon the upper portion of the hawsepipe to transfer the vertical loads through the hawsepipe to the lower support on the floating structure.

11 Claims, 4 Drawing Figures

TERMINATOR ASSEMBLY FOR A FLOATING STRUCTURE

BACKGROUND OF THE INVENTION p 1. Field of the Invention

The present invention relates to an apparatus for use in mooring a floating structure, such as a TLP or VMP, to the floor of a body of water and, more particularly, to such an apparatus for anchoring an upper end of a tension member within the floating structure.

2. Setting of the Invention

A floating structure used for drilling for and/or for production of hydrocarbons, such as tension leg platform (TLP) or a vertically moored platform (VMP), includes at least one working deck supported above the waterline by a plurality of vertical columns which extend into the water. A plurality of pontoons are horizontally connected between the columns beneath the waterline to provide additional buoyancy and structural integrity to the floating structure. The floating structure is anchored to the floor of a body of water by connecting a plurality of tension members, also known as tendons or tethers, from an anchoring template on the floor of the body of water to a connection point within the floating structure. An upper portion of each of the tension members is connected within the column above the waterline at a connection point, called a mooring flat.

Problems have been encountered with this arrangement because the tension members are constantly under static tension and the dynamic tension on each tension member varies in magnitude according to the wind and wave action acting upon the floating structure. A top portion of each tension member includes a locking mechanism which acts upon the mooring flat within the column of the floating structure. What happens is the tension in the tension member puts compressive downward force on the column that could cause the buckling of the column's wall.

To alleviate this problem, additional reinforcement must be added within the column and at other internal supports within the floating structure; however, these additional reinforcements cause a large increase in the weight and fabrication costs of the floating structure.

It is recognized that it is advisable to transfer the mooring forces of the tension members to the lowestmost position within the column. In this manner the tension forces are applied to the strongest portion of the floating structure, allowing for the upper portion of the column to not be unnecessarily placed under the compressive loads and the additional reinforcement is not needed. One arrangement to solve the buckling problem is to place the locking mechanism on a support arm extending from a horizontal pontoon or a vertical column beneath the waterline. However, this arrangement is not desired because the locking mechanism is exposed to water-induced corrosion and is extremely difficult to work upon and to inspect, if necessary. Another arrangement is to place the locking mechanism within a small compartment within a lower portion of the column or the pontoon. However, since this arrangement is again below the waterline, a costly air pressurization system is required to prevent the compartment from being flooded when the locking mechanism is to be worked upon or inspected.

There is a need for an anchoring arrangement for a tension member that is above the waterline for ease of maintenance, but which applies the mooring forces to the lowermost portion of the floating structure to thereby reduce the cost and the weight of the floating structure.

SUMMARY OF THE INVENTION

The present invention has been designed to overcome the foregoing deficiencies and meet the above-described needs. The present invention comprises a terminal assembly for use in mooring a floating structure, such as a TLP or VMP, to the floor of a body of water. The floating structure includes an upper termination point, such as a mooring flat, and a lower termination point, such as a lower mooring flat. A hawsepipe extends from adjacent the upper termination point downward to and is supported by the lower termination point. A tension member extends downwardly from adjacent the first termination point coaxially through the hawsepipe and a lower end of which is adapted for connection to the floor of a body of water. A locking mechanism, such as a threaded nut assembly, is connected to an upper portion of the tension member but is not in contact with the upper termination point and maintains the tension member in tension by acting upon the hawsepipe. By utilizing the terminator assembly of the present invention, the locking mechanism is spaced above the waterline in a region of the floating structure which is easily accessible for maintenance and inspection, but at the same time applies the mooring forces through the hawsepipe downwardly onto the more substantial portion of the floating structure. Therefore, the additional reinforcements are not required.

DETAILED DESCRIPTION OF THE PREFERRED EMBODIMENTS

Figure 1:
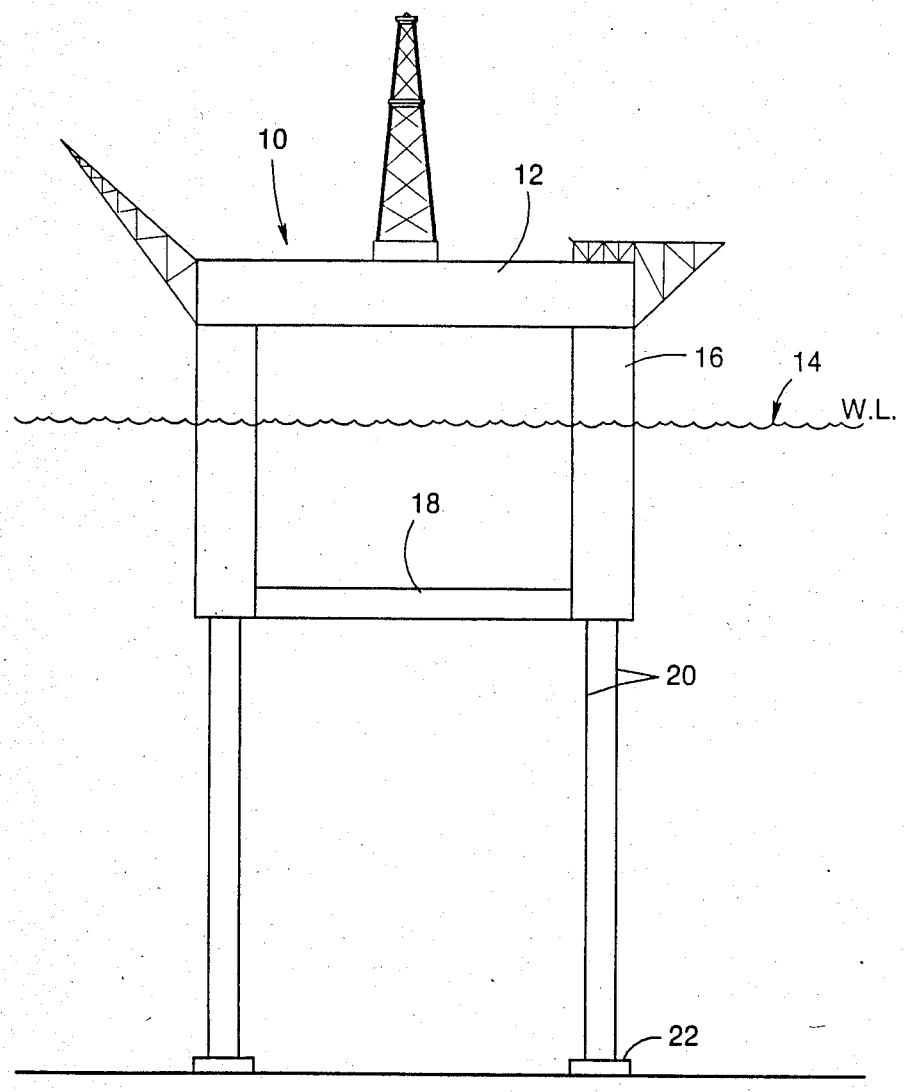
FIG. 1 is an elevational view of a floating structure, such as a TLP, which utilizes tension members as mooring elements.

The present invention comprises a terminator assembly for use in mooring a floating structure to the floor of a body of water. For the purposes of the present discussion, the floating structure will be a tensioned leg platform (TLP) but could be a vertically moored platform (VMP), or any other floating structure which utilizes tension members for mooring purposes.

A TLP 10 includes an upper deck or mooring flat 12 which is supported above the waterline 14 by a plurality of vertical column 16. The TLP 10 can be in cross-section rectangular, square, circular, or triangular as desired. Additional buoyancy below the waterline 14 is provided by bottle-shaped canisters connected around or internal with the columns 16 (not shown) or by horizontal pontoons 18 extending between the columns 16. A plurality of pipe called tension members 20 extend from an anchored position on the floor of the body of water, such as an anchoring template 22, under tension to a preselected location within the TLP 10, as will be described below.

Figure 2:
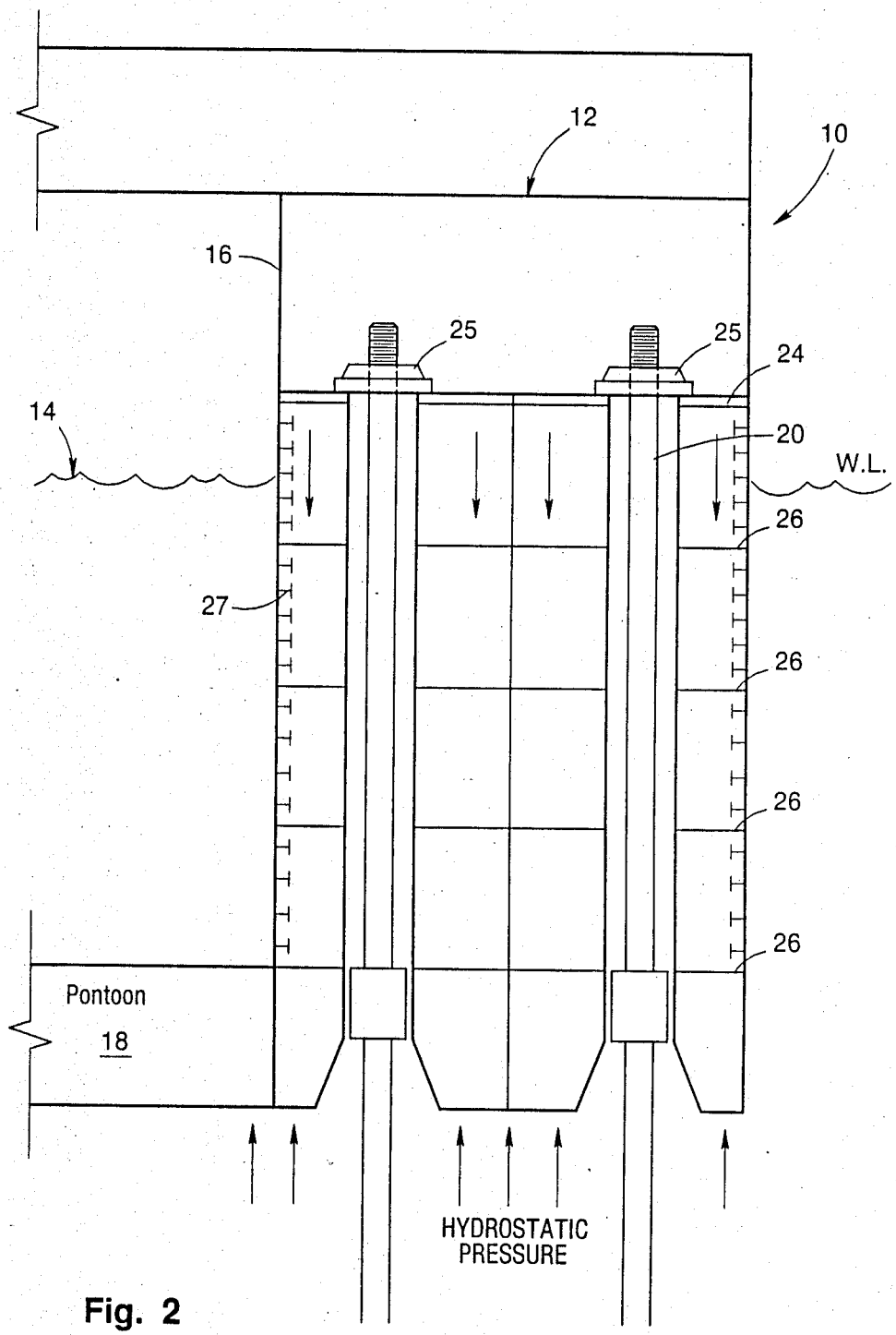
Fig. 2 PRIOR ART
FIG. 2 is an elevational view of a prior art terminator assembly for use on a floating structure.

As discussed before, the prior art arrangement for mooring a TLP was to place the locking mechanism within the columns that included internal stiffeners and supports. As shown in FIG. 2, a plurality of tension members 20 are terminated at a mooring flat 24 within the column 16 by using a prior art threaded locking mechanism 25. The problem associated with this arrangement is that a plurality of horizontal panels or additional mooring flats 26 and stiffeners 27 are absolutely needed to prevent the column 16 from buckling.

Figure 3:
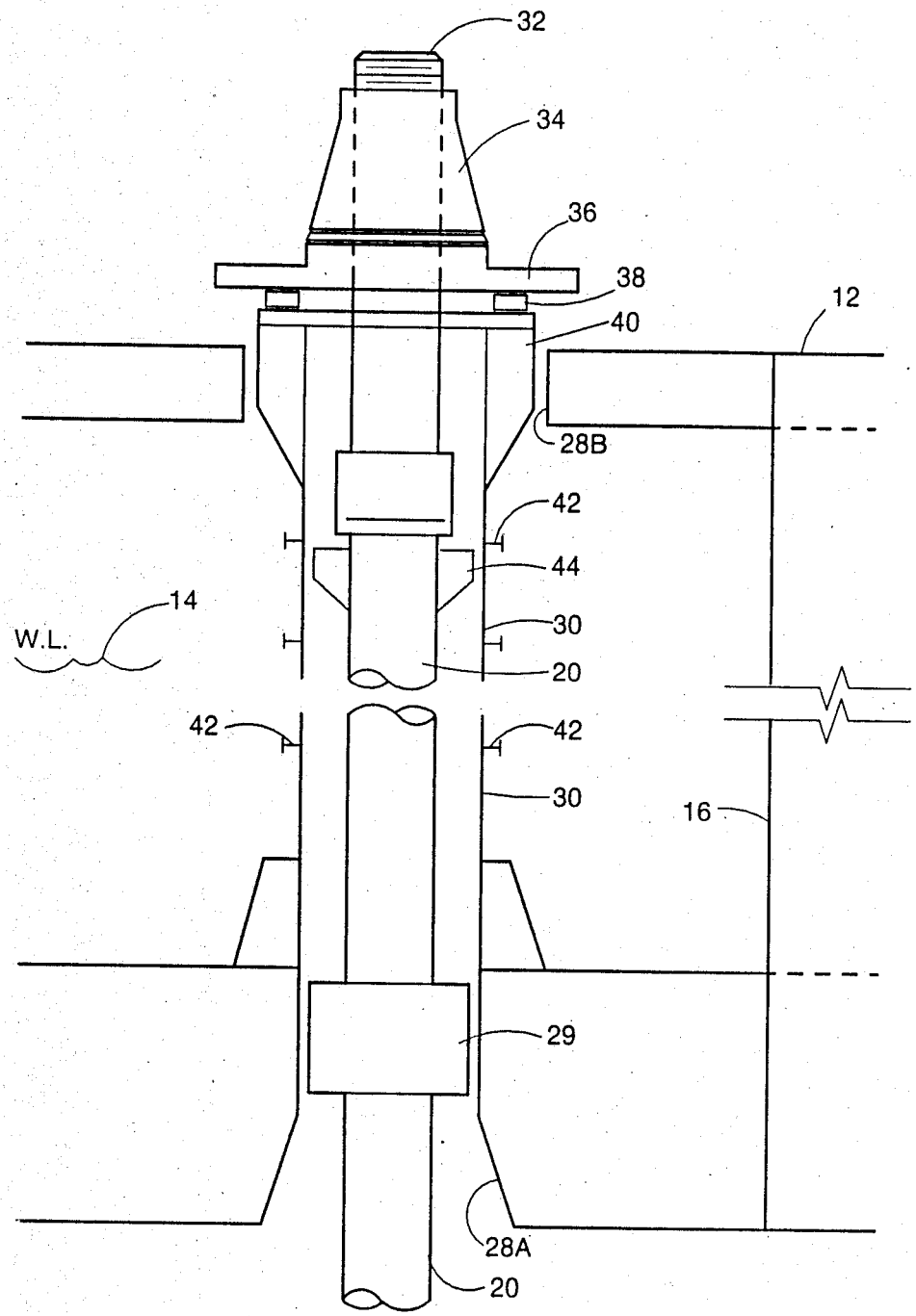
FIG. 3 is a partial cutaway, elevational view of a terminator assembly of the present invention.

One embodiment of the present invention is shown in FIG. 3. In this embodiment, the tension members 20 extend and are connected to the floating structure extension from the column 16. An opening 28A is provided within a submerged cantilever member or arm or a portion of the pontoon 18 adjacent the base of the column 16. The opening 28A is coaxially aligned with an upper opening 28B in a horizontal support or mooring flat 12 exterior of the TLP 10. A tension member 20 extends upwardly from the sea floor and includes, if desired, a flexible horizontal flex or reaction joint 29 within the opening 28A. The tension member 20 extends a certain length above the opening 28B in the mooring flat 12. Positioned around each tension member 20 is a hawsepipe 30, which is connected as by welding or bolts to or can rest upon the pontoon 18. An uppermost portion of the tension member 20 includes a threaded portion 32 for interconnection with a locking mechanism 34, such as a tubular or hexagonal nut or the like. A load base 36 is provided around the tension member 20 for use with one or more load cells 38 provided between the lower surface of the load base 36 and an upper surface of an upper centralizer 40, which is mounted to the hawsepipe 30. The purpose of the load cells 38 will be discussed later.

The exterior surface of the hawsepipe 30 can be provided with a plurality of ring stiffeners 42 and with internal fin-type centralizers 44 or packers, if desired, to maintain the tension member 20 in proper vertical alignment. Since the tension member is internally coaxial to the hawsepipe, global buckling of the hawsepipe in compression is not possible.

It should be noted that, as shown in FIG. 3, no portion of the tension member 20 directly comes into contact with the mooring flat 12. As can be seen, the tension forces on the tension member 20 and the hawsepipe 30 pull or draw the load base 36 onto the load cells 38 from which a reading of the amount of tension on each tension member 20 can be made. Further, the tension force applied onto the load base 36 is transferred through the hawsepipe 30 to the submerged pontoon 18. By way of this arrangement, the locking device 34 and the load base 36 are at a position above the waterline and can be easily accessible for maintenance and inspection. However, the mooring forces are transferred not upon the mooring flat 12, which would cause compression loads on the column 16 as shown in FIG. 2, but rather onto the strongest portion of the structure such as the lowermost mooring structure associated with the column 16.

Figure 4:
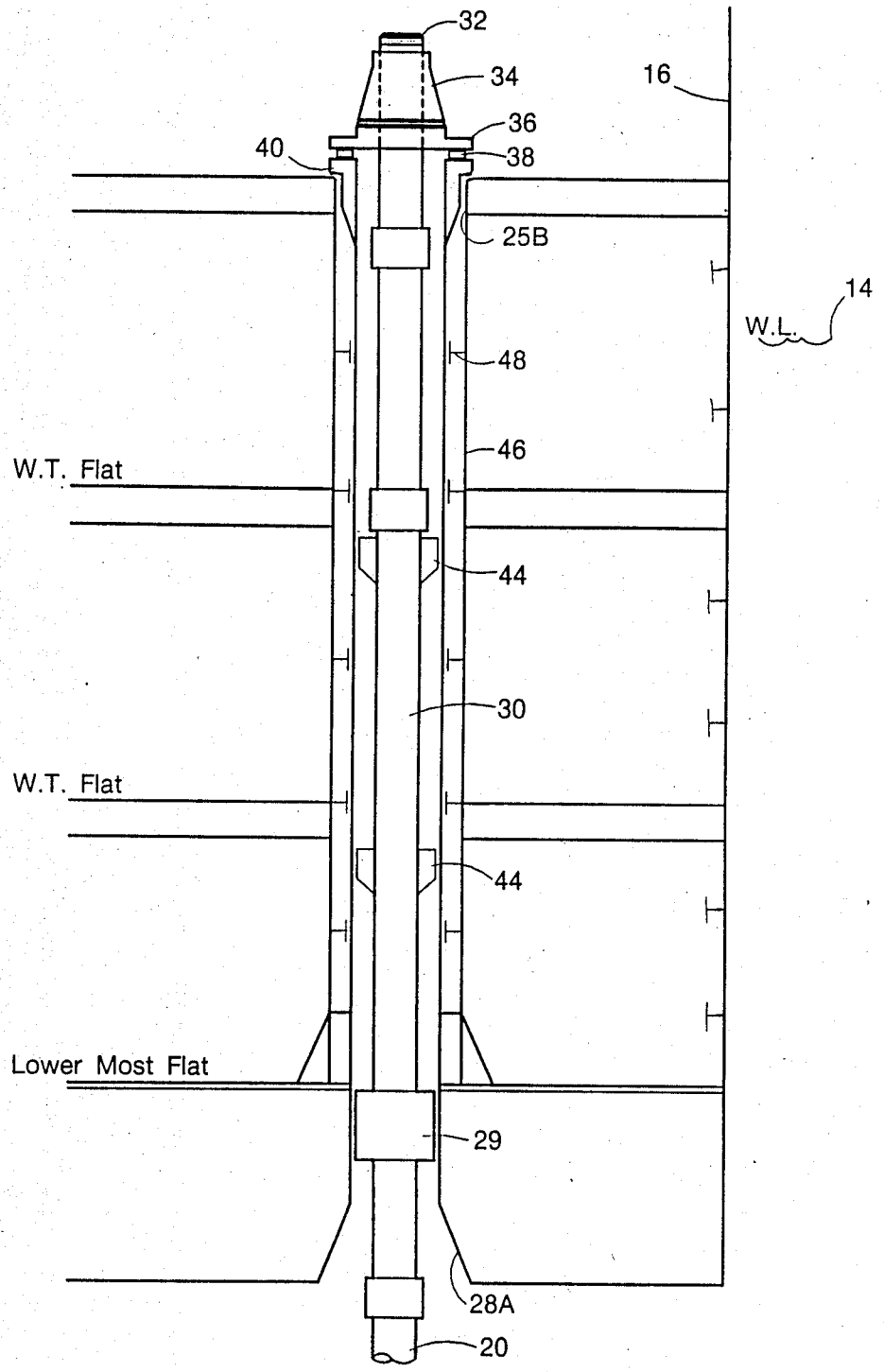
FIG. 4 is a partial cutaway, elevational view of an alternate embodiment of a terminator assembly of the present invention.

An alternate embodiment of the present invention is shown in FIG. 4 wherein the terminator assembly is included within the column 16 and not exterior thereof, as shown in FIG. 3. Further, the embodiment shown in FIG. 4 includes an additional conduit called a conductor pipe 46 with a plurality of internal centralizers 48. The remaining features of the structure shown in FIG. 4 are the same as that shown in FIG. 3 and are labeled accordingly. The purpose of the conductor pipe 46 is to provide a waterproof seal around the hawsepipe 30.

In the deployment operation of the present invention, the floating structure 10 is ballasted downwardly to its design draft. The tension members 20 can then be deployed through the top of the hawsepipe 30 normally by threaded couplings. Alternately, the portion of the tension member 20 both below the horizontal flex joint 29 can be assembled externally and in one piece and entered through the hawsepipe 30 from below through the opening 28A. During the deployment stage, sliding spider plates (not shown) adjacent the top of the assembly can be opened to the outside diameter of the hawsepipe 30, thereby allowing the passage of the tension member 20 segments and the associated connectors.

The spider plates can then be closed to provide a hanging off shoulder for the tension member connectors. A latch-on sequence can be provided using guideline operating procedures. After the tension members are connected to the template 22, the upper segment of the tension member 20 can be connected to a heave compensator (not shown), if desired, and the spider plates can be replaced by two slip plates. These two slip plates are then used to accommodate the segment's largest outside diameter and provide a landing surface for the locking mechanism 34. Thereafter, the floating structure 10 is deballasted to place the plurality of tension members 20 under tension as is desired.

Wherein the present invention has been desired in particular relation to the drawings attached hereto, it should be understood that other and further modifications, apart from those shown or suggested herein, can be made within the spirit and scope of the present invention.

What is claimed is:

1. A terminator assembly for use in mooring a floating surface to the floor of a body of water, the floating structure having an upper support and a lower support, comprising:

a hawsepipe extending downwardly from adjacent the upper support and supported by the lower support, a tension member extending downwardly from adjacent the upper support through the hawsepipe and the lower support, the tension member having a lower end adapted for connection to the floor of the body of water, and locking means connected to an upper portion of the tension member for maintaining the tension member in tension by acting upon an upper portion of the hawsepipe without transferring primary tension load forces to the upper support.

2. The terminator assembly of claim 1 wherein an upper portion of the hawsepipe extends above an upper surface of the upper support and a lower portion of the hawsepipe is connected to an upper surface of the lower support.

3. The terminator assembly of claim 1 wherein the tension member includes a flex reaction joint.

4. The terminator assembly of claim 1 wherein the locking means comprises a rotatable nut cooperable with threads provided on the upper portion of the tension member.

5. The terminator assembly of claim 4 and including at least one load cell between the load cell and the upper portion of the hawsepipe.

6. The terminator assembly of claim 1 and including at least one centralizer on the tension member for controlling the lateral movement of the tension member within the hawsepipe.

7. The terminator assembly of claim 1 and including a conductor pipe coaxially positioned around the hawsepipe to provide a water-tight compartment for the hawsepipe.

8. The terminator assembly of claim 1 and including a plurality of stiffeners on the exterior surface of the hawsepipe.

9. The terminator assembly of claim 1 wherein the hawsepipe is mounted exterior of a vertical column on the floating structure from which the upper and the lower supports extend.

10. The terminator assembly of claim 1 wherein the hawsepipe is mounted interiorly of a vertical column on the floating structure from which the upper and the lower supports are connected.

11. A terminator assembly for use in mooring a floating structure to the floor of a body of water, the floating structure having an upper mooring flat above the design waterline and a lower mooring flat mounted beneath the design waterline to a vertical column supporting the upper mooring flat, comprising a hawsepipe extending downwardly through an opening in the upper mooring flat and supported by the lower mooring flat;

a tension member extending downwardly through the hawsepipe and having a lower end adapted for connection to the floor of the body of water; and locking means connected to an upper portion of the tension member for maintaining the tension member in tension by acting upon an upper portion of the hawsepipe without transferring primary tension load forces to the upper support.

* * * * *